US006011270A

United States Patent [19]

Izumi

[11] Patent Number: 6,011,270

[45] Date of Patent: Jan. 4, 2000

[54] FAR INFRARED RAYS RADIATION DEVICE

[75] Inventor: Masahiko Izumi, Kawasaki, Japan

[73] Assignees: THK Co., Ltd., Tokyo-to; Showa Device Plant Co., Kanagawa-ken, both of Japan

[21] Appl. No.: 08/988,165

[22] Filed: Dec. 10, 1997

[30] Foreign Application Priority Data

Dec. 10, 1996 [JP] Japan ..... 8-344509

[51] Int. Cl.[7] ..... F26B 3/30; H05B 3/10

[52] U.S. Cl. ..... 250/504 R; 392/433

[58] Field of Search ..... 250/504 R; 392/433

[56] References Cited

U.S. PATENT DOCUMENTS 3,895,216 7/1975 Hurko ..... 392/433

*Primary Examiner*—Jack I. Berman

*Attorney, Agent, or Firm*—Young & Thompson

[57] ABSTRACT

A far infrared rays radiation device comprises a first metal plate having a far infrared rays radiating layer and a convex shape with a predetermined radius of curvature; an electrical current applying equipment for heating the first metal plate and for applying minute electrical current to the first metal plate; a first insulation plate interposed between the first metal plate and the electrical current applying equipment; a second metal plate provided below the electrical current applying equipment and having a projecting portion to form the first metal plate into the convex shape or to keep the convex shape; a second insulation plate interposed between the electrical current applying equipment and the second metal plate; and lead wires for supplying a predetermined electrical current to the electrical current applying equipment. Thus, the far infrared rays radiation device can radiate far infrared rays in a wavelength over 3.6 $\mu$m. Since this wavelength adapts to a waveband in which the molecules of the material to be treated is naturally vibrated, it is possible to dry out the material effectively.

8 Claims, 3 Drawing Sheets

FAR INFRARED RAYS RADIATION DEVICE

BACKGROUND OF THE INVENTION

This invention relates to a far infrared rays radiation device applied to an industrial drying treatment or the like.

A conventional far infrared rays radiation device has structure, as shown in FIG. 6, in which a filament is housed in a glass bulb 1, the filament is electrically supplied from a socket portion 2 connected to an external power source to be heated to a temperature of about 2000° C., and thus far infrared rays reflect from a reflector 3 provided in the glass bulb 1 and radiate to a material to be treated.

However, the far infrared rays radiation device of this type actually radiates infrared rays in a waveband of 0.7 through 3.6 μm. This waveband is different from a waveband of the far infrared rays over 3.6 μm corresponding to a wavelength absorption band of atoms or molecules of materials, and does not correspond to a natural frequency of molecules of materials. Therefore, the above device involves problems that it requires a long time to perform a satisfactory drying treatment and it is not possible to carry out the treatment efficiently. Then, it has been requested to improve efficiency, durability, or mass manufacturing, and to reduce manufacturing cost, at the time when the far infrared rays radiation device has become popular in recent years.

SUMMARY OF THE INVENTION

Therefore, one of the objects of the present invention is to provide a far infrared rays radiation device adapted to a waveband over 3.6 μm, which corresponds to a wavelength absorption band of atoms or molecules of materials, and capable of efficiently radiating far infrared rays which can enhance natural vibrations of molecules of materials to obtain fine dry effect against materials to be treated.

In order to obtain the above object, a far infrared rays radiation device of the present invention comprises a first metal plate having a far infrared rays radiating layer and a convex shape with a predetermined radius of curvature; an electrical current applying equipment for heating the first metal plate and for applying minute electrical current thereto; a first insulation plate interposed between the first metal plate and the electrical current applying equipment; a second metal plate provided below the electrical current applying equipment and having a projecting portion to form the first metal plate into the convex shape or to keep the convex shape; a second insulation plate interposed between the electrical current applying equipment and the second metal plate; and lead wires for supplying a predetermined electrical current to the electrical current applying equipment.

Another object of the present invention is to provide a far infrared rays radiation device having the above advantages and capable of restraining heat distortion.

In order to obtain the above object, a far infrared rays radiation device comprises a first metal plate having a far infrared rays radiating layer and a convex shape with a predetermined radius of curvature; an electrical current applying equipment for heating the first metal plate and for applying minute electrical current thereto; a first insulation plate interposed between the first metal plate and the electrical current applying equipment; a second metal plate provided below the electrical current applying equipment, the second metal plate having a projecting portion to form the first metal plate into the convex shape or to keep the convex shape and means for releasing heat distortion; a second insulation plate interposed between the electrical current applying equipment and the second metal plate; and lead wires for supplying a predetermined electrical current to the electrical current applying equipment.

In the present invention, the first insulation plate can have a thickness in a range of 0.2 through 0.5 mm. The electrical current applying equipment can comprise a coil, and the coil can comprise an electrode.

According to the present invention, induced electrical current is applied to the first metal plate by the electrical current applying equipment via the first insulation plate, and free electrons, a number of which is equal to or more than $10/cm^2$, in the far infrared rays radiation layer move randomly, and therefore far infrared rays, as electromagnetic waves having a wavelength over 3.6 μm, radiate from the far infrared radiation layer in which quanta are accelerated. Note that, the relationship between the electrical power supplied to the electrical current applying equipment and the wavelength of the far infrared rays is as follows: 55 W (watt) correspond to 11 through 16 μm, 63 W correspond to 7 through 11 μm, 81 W correspond to 7 through 8 μm, and 105 W correspond to 4 through 7 μm.

The far infrared rays radiating from the device are transmitted in the air without being interfered by the air draft or the like, and are infiltrated into element compounds constituting the material to be treated. These far infrared rays correspond to the natural frequency of electrically charged molecules, i.e. equal to or greater than $45\times10^8$ times /sec. in accordance with the molecular weight, and therefore the material is efficiently dried out through the emission of heat generated by the vibration of molecules at a low temperature.

Namely, the electromagnetic waves correspond to a wavelength absorption band of atoms or molecules constituting materials over 3.6 μm, so that the molecules vibrate satisfactorily in accordance with covalence, dissociation and conjunction of the atoms of the material, and thus the material is dried out efficiently.

Although absorption wavelengths in materials are concentrated in a band of 3 through 20 μm, the conventional far infrared rays radiation device radiates infrared rays in the wavelength less than 3.6 μm, so that adaptation rate against an absorption spectrum of peculiar molecules of materials becomes a lower value. However, since the far infrared rays radiation device of the present invention radiates the electromagnetic waves in the waveband of the far infrared radiation and the waves are absorbed into the material to be treated, the molecules constituting materials, such as coating, are activated to be vibrated in a frequency of equal to or greater than $45\times10^8$ times per second, and the materials are dried out and hardened through covalence, dissociation and conjunction of the atoms of the materials owing to the mass thereof.

In the present invention, the first metal plate has a convex shape with the predetermined radius of curvature and the convex shape is formed or kept by the projecting portion provided at the second metal plate. Therefore, prestress is added to the first metal plate, so that it is possible to restrict influence of heat distortion caused by heat generated in the first metal plate, and it is possible to prevent the surface of the first metal plate from being irregular in accordance with the heat distortion. Accordingly, the device can withstand a long time usage.

Still further objects, features and other aspect of the present invention will be understood from the following detailed description of the preferred embodiments of the present invention with reference to the accompanying drawings.

DESCRIPTION OF THE PREFERRED EMBODIMENTS

An embodiment of the present invention will be described hereunder with reference to the accompanying drawings.

Figure 1:
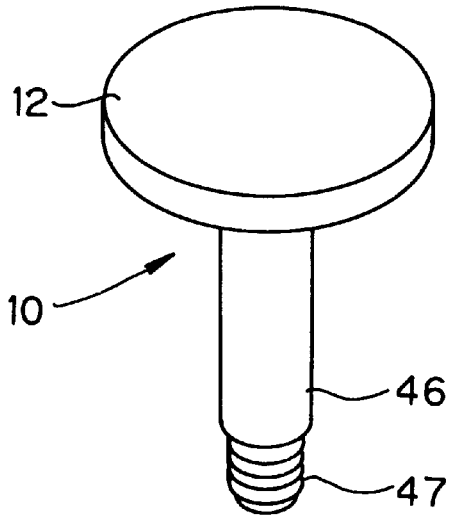
FIG. 1 is an external perspective view of a far infrared rays radiation device of the present invention.
Figure 2:
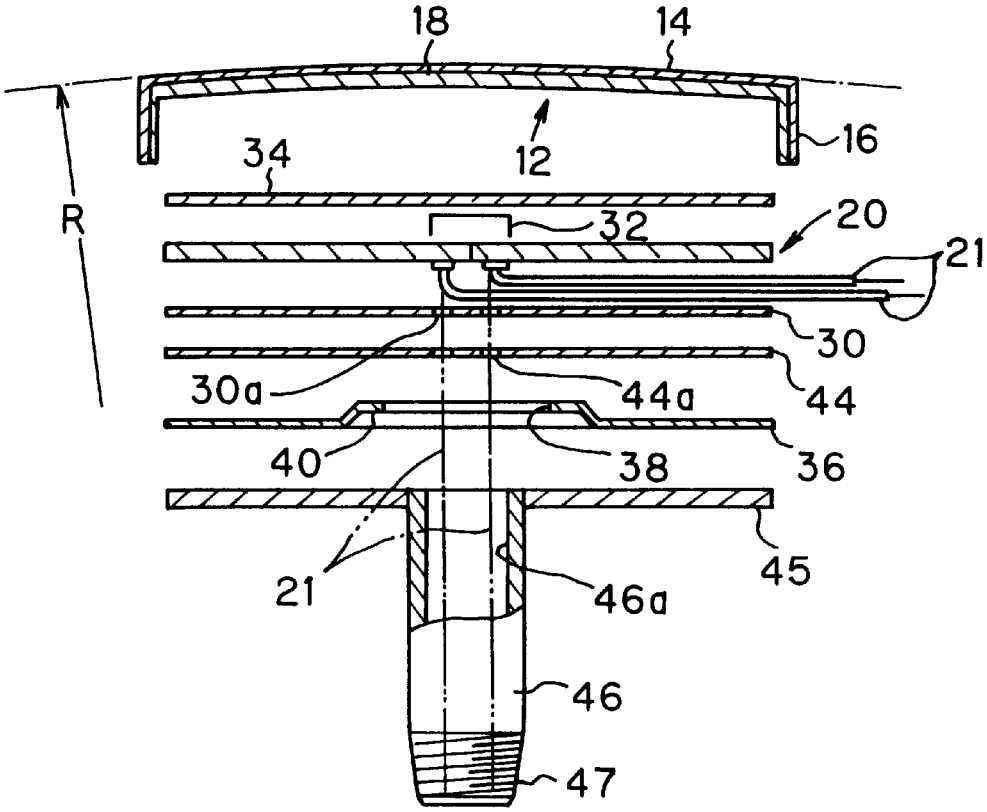
FIG. 2 is a sectional view of the far infrared rays radiation device in a disassembled state.

FIG. 1 is an external perspective view of a far infrared rays radiation device of the present invention and FIG. 2 is an exploded sectional view of the device. In these Figures, the reference numeral 10 denotes a far infrared rays radiation device comprising a structure mentioned below. The reference numeral 12 denotes a metal plate as a first metal plate made of aluminum metal. In this embodiment, the metal plate 12 is formed from aluminum metal, however, other metals, such as stainless steel and the like may be used. The metal plate 12 comprises an upper surface portion 14 formed into a convex shape with a predetermined radius of curvature, e.g. 1000 R ('R' denotes the radius), and a side surface portion 16 formed along with the circumference of the upper surface portion 14. Each of an upper surface and the lower surface thereof, or only the surface of the upper surface portion 14 of the metal plate 12 is provided with a far infrared rays radiating layer 18 for radiating far infrared rays. The far infrared rays radiating layer 18 is formed by the steps of: self-coloring aluminum peroxide with sulfuric acid or oxalic acid, oxidizing and dispersing metal atomic compounds of sub-micron order formed in the self-coloring step, and depositing oxides of the compounds onto the surface of the aluminum plate, and the layer 18 has an irregularity of 25 $\mu$m on the surface thereof. The far infrared rays radiating layer formed by the above process has been put on the market with trade names such as "SUPER RAY" (by Sky Aluminum Industry), "INFRARL" (by Japan Light Metal) and "SURFAS" (by Kawasaki Steel).

Figure 3:
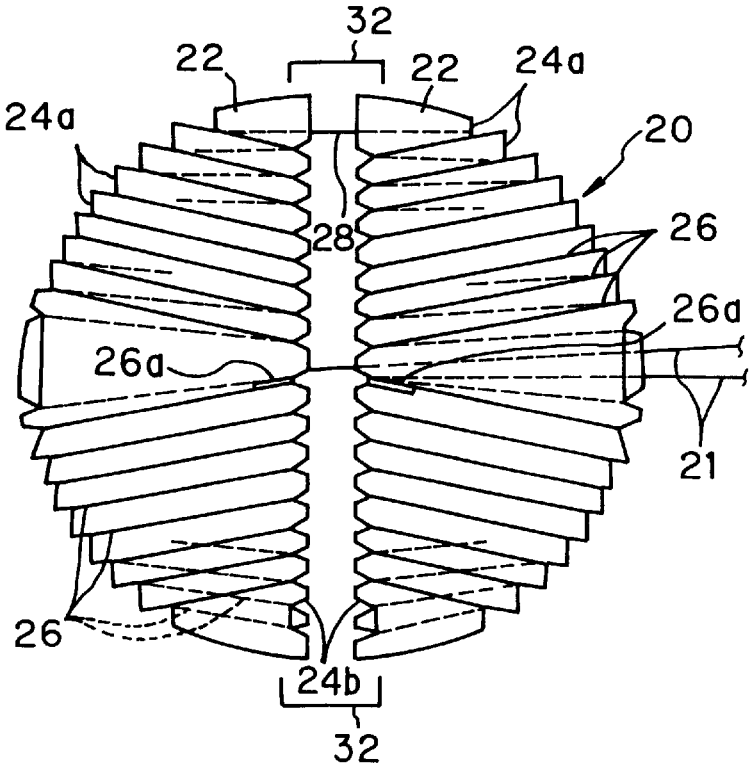
FIG. 3 is a schematic plan view of a coil provided in the far infrared rays radiation device.

Reference numeral 20 denotes a coil, which is minutely illustrated in FIG. 3, constituting an electrical current applying equipment. The coil 20 heats the aluminum metal plate 12 including the far infrared rays radiating layer 18 to a predetermined temperature and applies minute electrical current of 0.006 through 0.008 mA. The coil 20 is constructed by winding a nichrome wire 26 onto each of two insulation plates 22, 22, each of which is made of mica and which is formed in a semicircular shape. As shown in FIG. 3, each nichrome wire 26 is wound so as to be spaced with being hung on tooth like notched portions 24*a* . . . or 24*b* . . . formed at both of outer periphery portions of the insulation plates 22, 22 and side edge portions along with the diametrical direction thereof. Note that, the nichrome wires 26 are partially illustrated in FIG. 3 at the reverse sides of the insulation plates 22, 22. Each one end portion of the nichrome wires 26, 26 wounded onto the two insulation plates 22, 22 is connected to each other to form a bridge portion 28. Lead wires 21, 21 are connected to the other end portions 26*a*, 26*a* of the nichrome wires 26, 26 at a generally middle portion of each insulation plate 22 for supplying electrical power to the coil 20. These divided two insulation plates 22, 22 are confronted with each other and are integrally connected to an insulation plate 30 provided below by using a pair of stapler fasteners 32, 32. One of the stapler fasteners 32 is adjacent to the bridge portion 28. These fasteners 32 operate as electrodes for conducting induced current generated in the coil 20 to the aluminum metal plates 12. The insulation plates 30 is provided, at a middle portion thereof, with a hole 30*a* through which the lead wires 21, 21 pass.

Between the coil 20 and the aluminum metal plate 12 having the far infrared rays radiating layer 18 is interposed an insulation plate 34, as a first insulation plate, to prevent the nichrome wires 26 from contacting the metal plate 12. The insulation plate 34 has a diameter generally equal to that of a circle formed by the pair of insulation plates 22, 22 wounded by the nichrome wires 26, 26, and has a shape enough to cover the coil 20 entirely. Also, the insulation plate 34 has a thickness capable of allowing the above mentioned minute electrical current generated in accordance with the current in the coil 20 to be conducted to the aluminum metal plate 12. Namely, if the insulation plate 34 is made of Teflon type polyimide resin, the thickness is set in a range of 0.2 through 0.4 mm, and if the insulation plate 34 is made of mica material, the thickness is set in a range of 0.3 through 0.5 mm, preferably set at 0. 35 mm.

Figure 4:
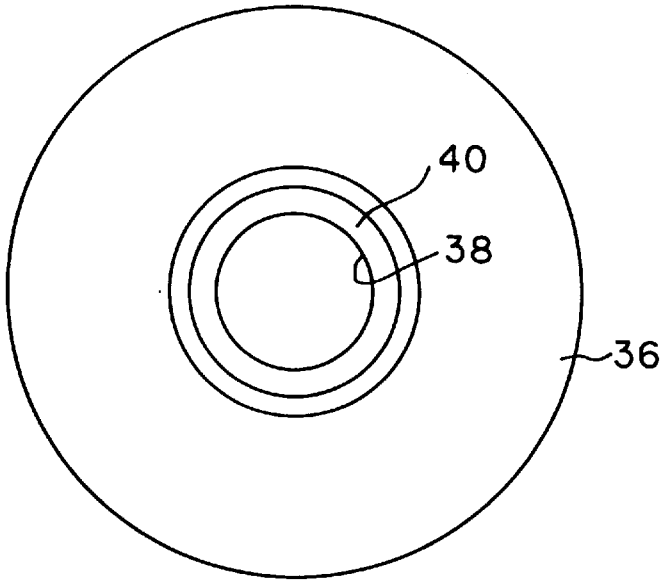
FIG. 4 is a schematic plan view of a pressure metal plate provided in the far infrared rays radiation device.

The reference numeral 36 denotes a pressure metal plate, as a second metal plate, provided to fix the aluminum metal plate 12. As shown in FIG. 4, this pressure metal plate 36 comprises, at its center portion, an opening 38 through which the lead wires 21, 21 for supplying the electrical power to the coil 20 pass, and a projecting portion 40 formed along with the circumference of the opening 38. Between this metal plate 36 and the coil 20 is interposed an insulation plate 44 made of mica to form a second insulation plate in cooperation with the insulation plate 30. Thus, a heat insulation effect is obtained. This insulation plate 44 is also provided, at its center portion, with a hole 44*a* through which the lead wires 21, 21 pass.

Below the pressure metal plate 36 is provided a bottom plate 45 fixed to an upper portion of a cylindrical socket support body 46. The socket support body 46 operates to prevent liberation of heat generated in the coil 20 to the atmosphere below the coil 20. This support body 46 is equipped with a socket portion 47 at a lower end portion thereof. When in the assembling, the lead wires 21, 21 of the coil 20 are inserted into an inner space 46*a* of the socket support body 46 through the holes 30*a*, 44*a* of the insulation plates 20, 44 and the opening 38 of the pressure metal plate 36, as indicated by chain lines in FIG. 2, and the wires 21, 21 are electrically connected to the socket portion 47. Therefore, the lead wires 21, 21 are electrically connected to the external power source (not shown) via a metal mouthpiece attached to the socket portion 47 without electrically contacting the plate 36 and the socket support body 46.

Also, when in the assembling, the metal plate 12 is fixed to a circumference portion of the bottom plate 45 with a lower circumference portion of the side surface portion 16 being bent inwardly and being staked to the bottom plate 45. The insulation plate 34, the coil 20, the insulation plate 30, 44 and the pressure metal plate 36, each of which is illustrated in a disassembled condition in FIG. 2, are held between the metal plate 12 and the bottom plate 45 in a state of being assembled each other in the above mentioned order.

Accordingly, in the above assembled state, since the projecting portion 40 of the pressure metal plate 36 provides the device with an upward pressure force, the assembled parts tightly contact each other and thus the minute electrical current is certainly conducted to the metal plate 12 by the coil 20. In particular, the upper surface portion 14 of the metal plate 12 is bent so as to make a convex shape with the predetermined radius of curvature by the pressure force from the projecting portion 40. Therefore, prestress is added to the metal plate 12, so that the heat distortion, which may cause irregularity of the surface of the plate 12, is not generated in the metal plate 12 even if the upper surface portion 14 is thermally deformed, and thus it is possible to keep the surface of the plate 12 ordinary stable to thereby improve a durability. Note that, it may be possible to provide the metal plate 12 with the convex shape having the predetermined radius of curvature before assembling, and to keep the convex shape of the plate 12 stable by the pressure force from the projecting portion 40 in the assembled condition.

In the above embodiment, the pressure metal plate 36 is separately provided from the bottom plate 45, however, it may be possible to omit the metal plate 36 and to provide the bottom plate 45 with a portion in a shape corresponding to the projecting portion 40. This structure is also included in the scope of the present invention.

Figure 5:
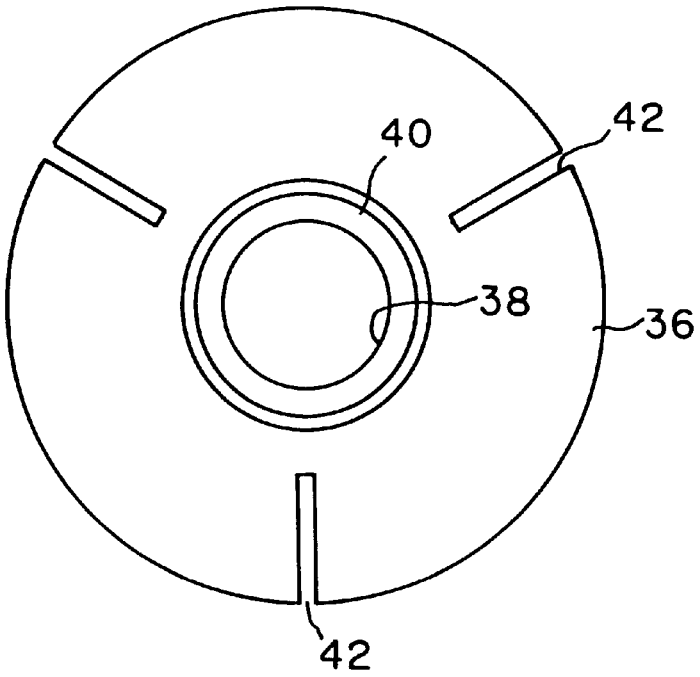
FIG. 5 is a schematic plan view showing a modification of the pressure metal plate provided in the far infrared rays radiation device.
Figure 6:
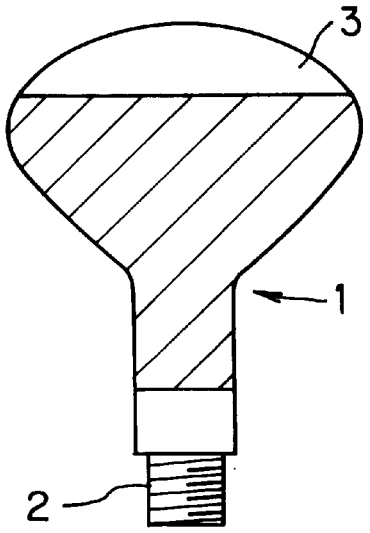
FIG. 6 PRIOR ART
FIG. 6 is a schematic view of a conventional far infrared rays radiation device.

FIG. 5 shows a modification of the pressure metal plate 36 having a plurality of slits 42 . . . extending from the circumference to the center thereof. These slits 42 operate to prevent the metal plate 36 from being irregular in accordance with the heat distortion of the metal plate 36 caused by the heat generated in the coil 20. Namely, the slits 42 operate as means for releasing heat distortion. If the irregularity is occurred, there may be a fear that a gap is formed at the staked portion between the side surface portion 16 of the metal plate 12 and the bottom plate 45, dust or the like in the atmosphere enters into the device 10 through the gap, and therefore the coil 20 breaks due to adhesion of the dust. Note that, the means for releasing the heat distortion is not restricted to the slits 42, and any structure capable of releasing the heat distortion may be used. For example, it may be possible to provide the metal plate 36 with a plurality of holes. If the bottom plate 45 is used as the pressure metal plate instead of the plate 36, the means for releasing the heat distortion should be provided on the bottom plate 45.

The present invention can include various modifications besides the above mentioned embodiments.

I claim:

1. A far infrared rays radiation device comprising:

a first metal plate having a far infrared rays radiating layer and a convex shape with a predetermined radius of curvature;

an electrical current applying equipment for heating the first metal plate and for applying minute electrical current thereto;

a first insulation plate interposed between the first metal plate and the electrical current applying equipment;

a second metal plate provided below the electrical current applying equipment and having a projecting portion to form the first metal plate into the convex shape or to keep the convex shape;

a second insulation plate interposed between the electrical current applying equipment and the second metal plate; and lead wires for supplying a predetermined electrical current to the electrical current applying equipment.

2. A far infrared rays radiation device of claim 1, wherein the first insulation plate has a thickness in a range of 0.2 through 0.5 mm.

3. A far infrared rays radiation device of claim 1, wherein the electrical current applying equipment comprises a coil.

4. A far infrared rays radiation device of claim 3, wherein the coil comprises an electrode.

5. A far infrared rays radiation device comprising:

a first metal plate having a far infrared rays radiating layer and a convex shape with a predetermined radius of curvature;

an electrical current applying equipment for heating the first metal plate and for applying minute electrical current thereto;

a first insulation plate interposed between the first metal plate and the electrical current applying equipment;

a second metal plate provided below the electrical current applying equipment, the second metal plate having a projecting portion to form the first metal plate into the convex shape or to keep the convex shape and means for releasing heat distortion;

a second insulation plate interposed between the electrical current applying equipment and the second metal plate; and lead wires for supplying a predetermined electrical current to the electrical current applying equipment.

6. A far infrared rays radiation device of claim 5, wherein the first insulation plate has a thickness in a range of 0.2 through 0.5 mm.

7. A far infrared rays radiation device of claim 5, wherein the electrical current applying equipment comprises a coil.

8. A far infrared rays radiation device of claim 7, wherein the coil comprises an electrode.

* * * * *